United States Patent [19]

Burtch

[11] Patent Number: 5,037,099

[45] Date of Patent: Aug. 6, 1991

[54] GAME DEVICE

[76] Inventor: Ronald P. Burtch, 122 Oakmeadow Blvd., Scarborough, Ontario, Canada, M1E 4G7

[21] Appl. No.: 489,190

[22] Filed: Mar. 8, 1990

[51] Int. Cl.[5] ..... B42D 15/00; A63B 71/00

[52] U.S. Cl. ..... 273/139; 283/903

[58] Field of Search ..... 273/138 R, 139, 148 R, 273/148 A; 283/48.1, 49, 50, 65, 100, 105, 903

[56] References Cited

U.S. PATENT DOCUMENTS 4,740,016 4/1988 Konecny et al. ..... 273/139

FOREIGN PATENT DOCUMENTS 0768040 9/1967 Canada ..... 283/903
1555462 11/1979 United Kingdom ..... 283/903
2075918 11/1981 United Kingdom ..... 283/903
2085308 4/1982 United Kingdom ..... 283/903

*Primary Examiner*—Edward M. Coven

*Assistant Examiner*—Raleigh W. Chin

*Attorney, Agent, or Firm*—Larson and Taylor

[57] ABSTRACT

A game device for simulating the card game of draw poker comprising a base having five windows formed therein and including, at, for example, five discrete locations on one surface thereof, card representations used in playing of the game. Each of the card locations is masked by a removable covering, such as scratch-off metallized film, so that the car representation at that location is revealed only when the covering is removed. A slide member, carrying plural rows of five cards forming different poker hands, is disposed in a pocket formed in the base and is slidable with respect to the base so that the various poker hands can selectively be brought into registration with the windows in the base. A selected number of the card representations on the base, when revealed, can be used to form different combinations (hands) with the card representations on the slide member.

20 Claims, 2 Drawing Sheets

GAME DEVICE

FIELD OF THE INVENTION

The present invention relates to game devices and, more particularly, to a game device of the lottery ticket type which simulates play of a game such as poker and is adapted to be used, for example, as a novelty item or promotional device.

BACKGROUND OF THE INVENTION

A number of games using a ticket or card have been developed which simulate various card games such as twenty-one and pontoon. Some examples which are the subject of a patent or patent application include: U.K. Patent Application No. 2,075,198A; U.K. Patent Application No. 2,114,445A; U.K. Patent Application No. 2,174,612A; and U.S. patent application No. 3,689,071 (Kucera).

U.K. Patent Application No. 2,075,198A discloses a lottery ticket which is used in simulating the game of pontoon and which includes three playing card representations concealed by means of a scratch-off or rub-off material. On top of, or otherwise alternative to, the scratch or rub-off material are printed alternative playing card representations, covered by a sheet having lines of weakening defining tear-back tabs. Each alternative playing card representation can be destroyed by abrading the coating over the concealed card representation, thereby simulating replacement of the former card representation by the latter.

U.K. Patent Application No. 2,114,455A discloses an "instant" lottery ticket which is also adapted for the playing of pontoon or twist, wherein a center layer includes three displaceable portions folded between upper and lower layers. Each portion carries a playing card representation and is respectively registerable with three windows in the upper or cover portion. A player can tear and displace the first two portions to reveal two playing card representations in the respective windows and then decide whether to tear and displace the third portion to display the third card to attempt to achieve a total equal or close to twenty-one but at the risk of exceeding twenty-one. Multiple card representations can be provided on each displaceable portion and they can be covered in whole or in part by an irreversibly removable coating portion.

U.K. Patent Application No. 2,175,612A discloses a game wherein removable coatings mask or obscure the words of each group. A player effectively "turns over" a card to ascertain the value thereof by scraping off the removable coating.

The Kucera patent discloses a game device for simulating blackjack or twenty-one comprising a longitudinal indici bearing scroll having a sequence or cards distributed in rows and columns. Opaque slides are provided so that cards indicated in any row can be revealed sequentially. Slide assemblies are provided to reveal a subsequent or prior row of cards in a column without disturbing an adjacent column.

A number of other similar games involve the removal, e.g., by scratching or rubbing off a covering material, such as an ink, wax, metallized layer or film or similar substance, or by tearing off a cover sheet or the like, so as to reveal information relating to the game. These include "instant" or "instant winner" lottery tickets or games and the like. Many such games are the subject of patents and some examples include: Miller U.S. Pat. No. 3,918,174; Donovan U.S. Pat. No. 4,508,513; Coppock U.S. Pat. No. 4,540,174; Ondis U.S. Pat. No. 4,643,454; and Steed U.S. Pat. No. 4,790,565. Other games of a similar nature employ tear-back tabs or other arrangements for covering or masking the game information. Some examples of such games include those disclosed in Brougton U.S. Pat. No. 3,655,198, Feldman U.S. Pat. No. 3,069,168 and U.K. Patent Application No. 2,082,119A.

A further type of game device, which possesses similarities to some of the games discussed above, employs a slide or the like which cooperates with window openings in revealing different game information during the playing of the game. Examples of toys and games of this general type include those disclosed in Kinberg U.S. Pat. No. 3,318,040; Howard U.S. Pat. No. 3,817,530; Frain U.S. Pat. No. 4,165,878; and Bromberg U.S. Pat. No. 4,202,546.

SUMMARY OF THE INVENTION

In accordance with the invention, a game device is provided which, although not limited to such a use, is particularly adapted for use as a novelty or promotional item by a hotel, gambling casino or the like for the amusement of their guests or customers. The game device itself is simple in construction and thus inexpensive to manufacture, but at the same time provides, as will appear, an interplay between different game representations that are revealed in different ways so as to interest and amuse a player of the game. In a preferred embodiment, the game device is used to simulate the game of poker and different ways of winning (e.g., by matching preselected winning hands to win prizes of different values) are provided so as to stimulate and maintain the interest of the player.

In accordance with one aspect of the invention, there is provided a game device comprising a base having at least one window formed therein and including, at at least one location on one surface thereof, game information used in playing of the game, the at least one location being masked by a removable covering so that the game information at that location is revealed only when the covering is removed; and a slide member, carrying different game information at a plurality of locations thereon related to the game information on the base, disposed behind the aforementioned surface of the base and slidable with respect to the base so that the further game information carried thereby can selectively be brought into registry with the at least one window in the base to form different combinations with game information at the at least one location.

Preferably, the base comprises a plurality of said windows and also includes game information at a plurality of different discrete locations thereon.

In advantageous embodiment the game device further comprises a cover which, when closed, covers the surface of the base carrying the game information so that the game information is not revealed until the cover is opened. In this embodiment, the cover preferably comprises an extension of the base, and the game device further comprises an adhesive or the like for releasably securing the cover to the base.

In a specific preferred embodiment, the base comprises a first wall member a surface of which constitutes the surface carrying the game information, and a second, separate wall member which, with said first wall member, defines a pocket therebetween in which the slide member is received. These first and second walls are joined together at least at the bottoms thereof, and each wall includes a tear line adjacent to the bottom thereof disposed so that tearing along the tear line provides separation of the joined bottoms of the walls to thereby permit access to the slide member. It will be appreciated that this enables the slide member to be moved so that different game information is presented through the window or windows in the base and also provides an indicatation that the device has been used. Advantageously, the tear line in at least one of the walls includes an inwardly projecting portion which, when the joined bottoms are removed, forms an indentation or notch in the lower edge of that wall for facilitating gripping of the slide member.

As indicated above, in a preferred embodiment, the game representations comprise representations of playing cards, and in an advantageous embodiment, the game device simulates the playing of poker. In this embodiment, the base includes five windows therein, the game representations comprise representations of playing cards, and the slide member comprises at least two spaced rows of five playing card representations thereon constituting two different poker hands.

In the embodiment thereof where the same device is adapted to simulate draw poker, the device comprises a base including representations of a plurality of cards on one face thereof and a plurality of apertures formed in that face; a slide member carrying at least two sets of card representations of five, different cards thereon corresponding to two different poker hands; and means for supporting said slide member relative to the base such that the two sets of card representations on the slide member can be selectively moved into registration with the apertures for viewing therethrough so that the different poker hands represented thereby are selectively exposed. In addition, the base further including a removable masking means for individually masking each of the card representations on the base so that the card representations are not revealed until the corresponding masking means is removed, whereby selective removal of different ones of the masking means will reveal different card representations on the face of the base which can be combined with the poker hands exposed through the apertures to form different poker hands.

Further features and advantages of the present invention are set forth in, or will be apparent from, the following detailed description of the preferred embodiments of the invention taken in conjunction with the accompanying drawings.

DESCRIPTION OF THE PREFERRED EMBODIMENTS

Figure 1:
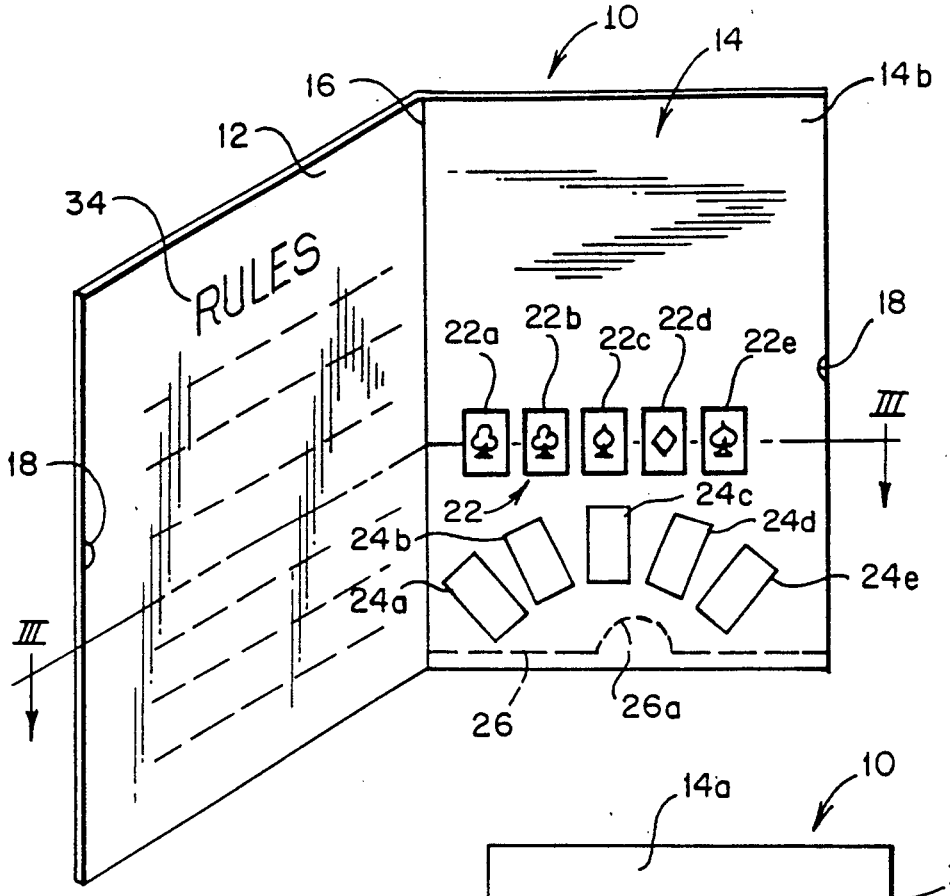
FIG. 1 is a perspective view of a game device in accordance with a preferred embodiment of the invention.
Figure 2:
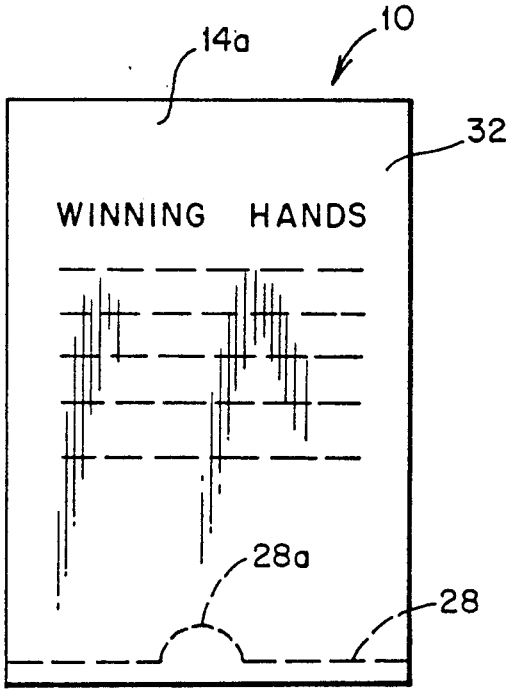
FIG. 2 is a side elevational view of the back cover of the device of FIG. 1.
Figure 3:
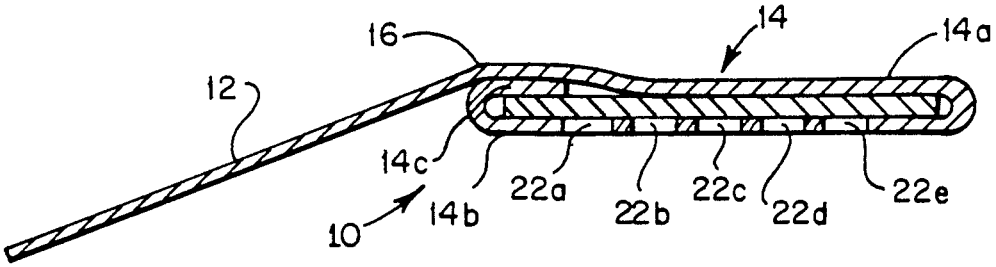
FIG. 3 is a cross-sectional view taken generally along line III—III of FIG. 1.

Referring to FIGS. 1 to 3, the basic components of a preferred embodiment of the game device of the invention are shown. In this embodiment, the device, which is generally denoted 10, includes a front cover 12 and back cover or base member 14 formed from a single rectangular sheet of a material such as cardboard or the like. A fold line 16 between front cover 12 and base member 14 enables front cover to be folded over the front of base member 14 and, in a preferred embodiment, to be secured thereto by, for example, cooperating spots of glue or another adhesive as indicated at 18.

As shown in FIG. 3, the base member 14 includes an outside back cover or wall portion 14 (see also FIG. 2) and a inside face or wall portion **14*b* (see also FIG. 1) which are sealed together, e.g., by gluing, along an inside end flap or bent over end portion, denoted 14*c*, formed at the distal edge of the inside face portion 14*b*. In other words, the end flap 14*c* contacts and is secured to the back cover portion 14*a* along a vertical line or area adjacent to the fold line 16 between front cover 12 and base member 14. As a consequence of this construction, a pocket or space is created in which an insert or slide member 20, described below, is received. It will be evident that the front cover 12, the back cover 14*a*, the inside face portion or wall 14*b*, and the end flap 14*c*, can be formed by suitable folding of a single piece of cardboard in the manner indicated in FIG. 3**.

As shown in FIGS. 1 and 3, five apertures or windows, collectively denoted 22 and individually denoted **22*a*, 22*b*, 22*c*, 22*d*, and 22*e*, are formed in inside face portion 14*b* of base member 14. Windows 22 are preferably rectangular in shape and arranged in a horizontal row across inside face portion 14*b***.

As indicated in FIG. 1, the inside face portion **14*b* also includes five discrete mask areas, collectively denoted 24 and individually denoted 24*a*, 24*b*, 24*c*, 24*d* and 24*e*, arranged in a fan pattern similar to the arrangement of a hand of cards. The mask areas 24 each comprise a mask or masking material, such as a metallized film, an ink, a wax or other substance, which masks a representation of a playing card provided on the surface of inside face portion 14*b***.

Figure 6:
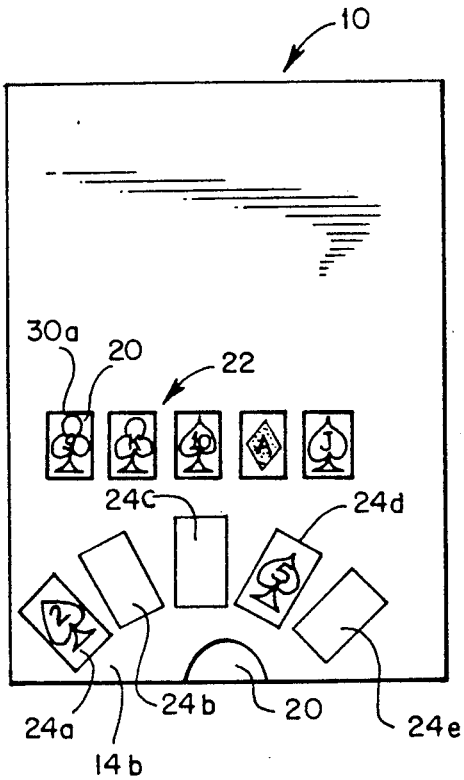

Although these card representations are not shown in FIG. 1, two such representations as shown in FIG. 6 which illustrates the result of removing mask areas **24*a* and 24*b***. In the example shown, representations corresponding to the two of spades and five of spades are revealed.

Although mask areas 24 each preferably comprises a metallized film (such as is commonly used in lottery cards or the like) which are scratched or rubbed off by, e.g., using the edge of a coin, such masking could be provided in a number of different ways such as through the provision of a tear-off covering formed by an overlying strip of paper or cardboard which would, e.g., be secured to the inside face portion **14*b*** by an adhesive, and which would, e.g., include a pull tab to assist in the removal thereof.

Further, it will be appreciated that windows 22 and mask areas 24 can be arranged in different patterns and that, for example, the windows 22 could be arranged in a fan shape pattern and the mask areas 24 in a horizontal row. However, for the sake of simplicity, it is preferred that windows 22 be arranged in a horizontal row as shown.

Face portion 14*b* and back cover portion 14*a* of base member 14 are also secured together at the tops and bottoms thereof to complete the pocket in which slide member 20 is received. As shown in FIGS. 1 and 2, tear lines 26 and 28 are provided at the bottoms of inside face portion 14*b* and back cover 14*a* which permit corresponding bottom strips or parts to be removed from both to thereby provide access to slide member 20 (see also FIG. 5). Corresponding indentations or notches, indicated at 26*a* and 28*a*, respectively, are formed at the bottom edges of face portion 14*a* and back cover 14*b* when these strips or parts are separated or removed, and these notches enable the slide member 20 to be readily gripped and pulled downwardly (see also FIG. 7).

Figure 4:
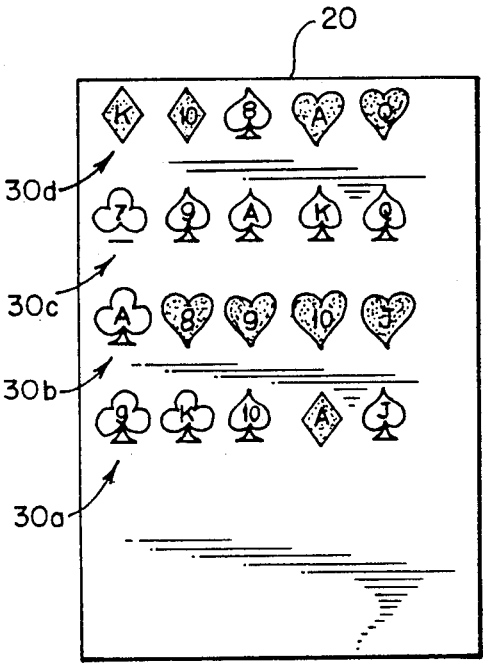
FIG. 4 is a side elevational view of the slide or insert of the device of FIG. 1.
Figure 5:
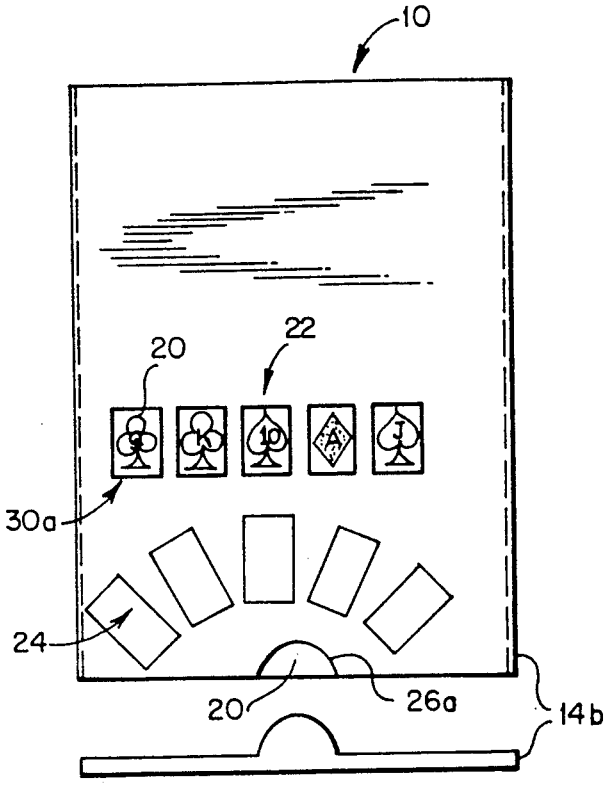
FIGS. 5 to 7 are side elevational views of the front inside face of the game device of FIG. 1 showing different steps in the playing of the game.

Referring to FIG. 4, the front face of slide member or insert 10 is shown in more detail and, as illustrated, includes four rows of markings or representations corresponding to four different playing cards, these rows being denoted 30*a*, 30*b*, 30*c* and 30*d* and each containing five such card representations corresponding to different poker hands. For example, as shown, bottom row 30*a* includes representations of the nine of clubs, the king of clubs, the ten of spades, the ace of diamonds and the jack of spades. As shown in FIG. 5, the insert or slide 20 is initially positioned in the pocket formed by base member 14, i.e., between inside face portion 14*b* and back cover 14*a*, such that the bottom row 30*a* of insert 20 is visible through windows 22 in inside face portion 14*b*.

Figure 7:
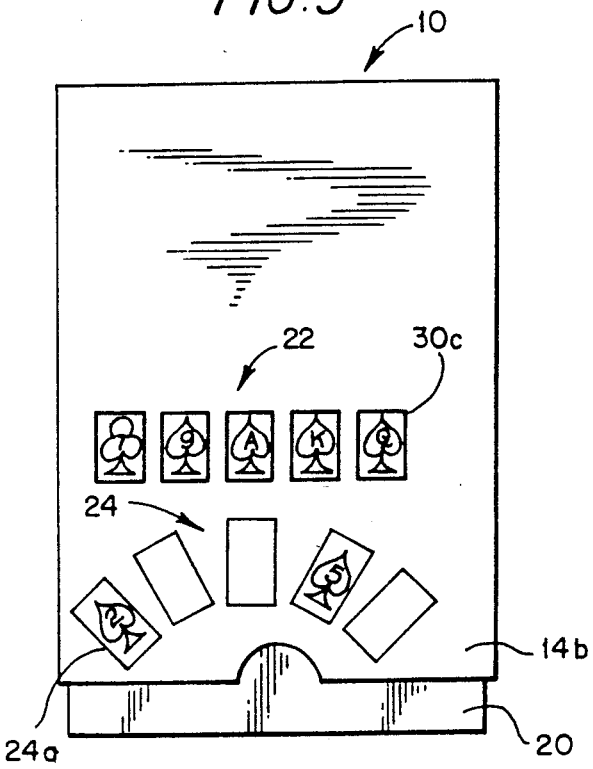

The operation of the game device of the invention will now be considered with particular reference to FIGS. 5 to 7. In accordance with one preferred method of playing the game, the game begins by separating the sealed edges of front cover 12 from base member 14 by breaking seal 18 so as to reveal the poker hand represented by the card representations that appear through the windows or openings 22.

In this example, it is assumed that the "house," e.g., a hotel which distributes the cards to the occupants of its hotel rooms presents prizes to the players (room occupants) for certain poker hands. Winning poker hands are listed, in this example, on back cover 14*a* as indicated at 32. Thus, if the revealed hand, i.e., the hand in row 30 which appears through windows 22, matches one of these hands, the player (room occupant) "wins" and is, e.g., paid a particular cash prize corresponding to that hand. Different prizes can be awarded for different hands and, as will be appreciated, the game can be designed by controlling the card representations so that, e.g., a relatively large number of small prizes, a smaller number of intermediate prizes and one large prize are awarded. It can also be provided that the poker hands represented on insert or slide 20 are "instant winners," i.e., match a winning hand, so that the hand on insert or slide 20 initially revealed through windows 22 when the front cover 12 is folded back can be made to be such a winner. It will be appreciated that a winning hand and, in particular, the hand for which the top prize is awarded would normally be a strong poker hand such as royal straight flush and that the hand revealed in the illustrative example would normally not be a winner.

To continue with the play of the game, the bottom strip or part of face portion 14*b* is next removed, as indicated in FIG. 5, to permit insert or slide member 20 to be moved. In this way, three additional poker hands, corresponding to card representations in rows 30*b*, 30*c* and 30*d*, can be sequentially presented through windows 22 and the player is given three more opportunities to be an instant winner. This mode of play would, of course, be explained in the rules of play and it is noted that the rules of play can be indicated on the back over 12 as indicated at 34 in FIG. 1. FIG. 7 illustrates a situation wherein insert or slide 20 has been pulled down to reveal row 30*b* on slide member 20.

If none of the poker hands in rows 30*a* to 30*d* is a "winner" or if the player wishes to attempt to win a better prize, the player is given a further opportunity to win by scratching off a limited number (e.g., two) of the masks 24 to improve his poker hand. In this example, as shown in FIG. 6, two of the masks, 24*a* and 24*d*, have been scratched off revealing the two of spades and the five of spades. In this embodiment of the game, these two additional "cards" are added to the poker hand on the slide 20 and the player then selects the five best cards to form a poker hand. In the example illustrated, the revealed (unmasked) cards do not help the player. It will be understood by poker players that the maximum improvement of the hand represented in row 30*b* that would be available by "drawing" only two cards under the rules, would be provided by the addition of a queen so as to produce a high straight.

To continue play, the player moves slide 20 so that the next poker hand, i.e., that of the next row 30*b*, is revealed through windows 22, as shown in FIG. 7. Since this row contains four spades, either of the additional cards at locations 24*a* and 24*d* can be used to complete a flush, which could be a prize winning hand depending how the game has been set up.

The player may then continue to move slide member 20 to reveal, in succession, the next two rows and combine the unmasked cards with the cards in these cards.

It will, of course, be understood that a player can scratch off his or her two choices initially and then move slide 20 to determine whether the "cards" so selected improve any of the four hands carried by slide 20.

It will also be appreciated that by using a masking system, one can readily determine that the proper number of selections have been made, i.e., that the player has made only two selections (and not three) consistent with the rules provided for.

In a variation on the illustrative example discussed above, it can be required that the "cards" unmasked or revealed by removal of two of the masks 24 be directly substituted for the "cards" in the same positions showing through windows 22 (rather than simply added) so that, in the example given, the card behind mask 24*d* would not complete the flush (a spade would be substituted for a spade) while that behind mask 24*a* would complete the flush (a spade would be substituted for a club).

Further, different prizes would be awarded depending on whether a winning hand was arrived at with one "scratch" or two "scratches." In this mode of play, the player would normally wish to view all of the hands carried by slide 20, before removing any of the masks 24, so as to locate the positions of the cards that could help the hands on the slide. Thus, the selection process would not be random, and in the illustrative example, a player might wish to scratch the mask 24*a* first in hopes of obtaining a queen or a spade (and thus fill the straight in the bottom row 30*a* or the flush in the second row 30*b*) and then scratch off mask 34*c* in hopes of revealing a heart to complete the flush in the top row 30*d*. This, of course, assumes that such hands would be designated by the house as "winners." It will be appreciated that this mode of play might be more appealing to sophisticated poker players although it may be that a simpler game such as described above would have appeal to a wider audience. In fact, in a simplified embodiment, the cover 12 could be eliminated. With such an embodiment, the slide 20 would be designed so that no cards show through windows 22 initially, i.e., so that the cards on slide 20 would be revealed only after the slide is moved.

Although the device of the invention is particularly suited to a game such as poker and possesses special advantages in such an application, it is also possible to play other card games and even other, different games using the same general device. For example, to play twenty-one or blackjack, a reduced number of windows 22 could be used (e.g., two) and the "cards" exposed through these windows could be used as the "dealt" cards and "cards" under the masks used as "hit" cards.

It will be appreciated that an important aspect of the invention involves the interplay between the scratch-off representations and the different representations that are able to be viewed through the windows 22 and, in particular, the variations in this interplay that are provided by the ability to view different game representations through the windows 22 by movement of the slide 20.

Although the present invention has been described relative to specific exemplary embodiments thereof, it will be understood by those skilled in the art that variations and modifications can be effected in these exemplary embodiments without departing from the scope and spirit of the invention.

I claim:

1. A game device comprising a base having at least one window formed therein and including, at of least one location on one surface thereof, game information used in playing of the game, said at least one location being masked by a removable covering so that the game information at that location is revealed only when the covering is removed; and a slide member, carrying different game information at a plurality of locations thereon, related to the game information on said one surface of said base, disposed behind said surface of said base and slidable with respect to said base so that said further game information can selectively be brought into registry with said at least one window in said base to form different combinations with game information at said at least one location.

2. A game device as claimed in claim 1 wherein said base comprises a plurality of said windows.

3. A game device as claimed in claim 1 wherein said base includes game information at a plurality of locations thereon.

4. A game device as claimed in claim 1 further comprising a cover which, when closed, covers said one surface of said base.

5. A game device as claimed in claim 1 wherein said cover comprises an extension of said base and said device further comprises adhesive means for releasably securing said cover to said base.

6. A game device as claimed in claim 1 wherein said base comprises a first wall member, a surface of which constitutes said one surface, and a second, separate wall member which, with said first wall member, defines a pocket therebetween in which said slide member is received.

7. A game device as claimed in claim 6 wherein said first and second walls are joined together at least at the bottoms thereof and each wall includes a tear line adjacent to the bottom thereof disposed so that tearing along the tear line provides separation of the joined bottoms of the walls to thereby permit access to said slide member.

8. A game device as claimed in claim 7 wherein the tear line in at least one of said walls includes an inwardly projecting portion which forms an indentation in the lower edge of that wall for facilitating gripping of said slide member.

9. A game device as claimed in claim 1 wherein said game representations comprise representations of playing cards.

10. A game device as claimed in claim 1 wherein said base includes five of said windows therein, said game representations comprise representations of playing cards and said slide member comprises at least two spaced rows of five playing card representations thereon.

11. A game device comprising a base member having a plurality of windows formed therein and including, at a plurality of discrete locations on one face thereof, game information used in the playing of the game, each of said locations being masked by a removable covering so that the information at the locations is revealed only when the covering is removed; and a slide member carrying, of at least two different locations thereon, further game information related to the game information on the face of said base and disposed behind said face of said base and slidable with respect to said base so that said further game information can be selectively brought into registry with said windows in said base.

12. A game device as claimed in claim 11 further comprising a cover which, when closed, covers said one surface of said base.

13. A game device as claimed in claim 11 wherein said base comprises a first wall member, a surface of which constitutes said one surface, and a second, separate wall member which, with said front wall member, defines a pocket therebetween in which said slide member is received.

14. A game device as claimed in claim 11 wherein said first and second walls are joined together at the bottoms thereof and each wall includes a tear line adjacent to the bottom thereof disposed so that tearing along the tear line provides separation of the joined bottoms of the walls to thereby permit access to said slide member.

15. A game device as claimed in claim 11 wherein said base includes five of said windows therein, said game representations comprise representations of playing cards, and said slide member comprises at least two spaced rows of five playing card representations thereon.

16. A card game simulating device comprising a base including representations of a plurality of cards on one face thereof and a removable masking means for individually masking each of the card representations so that the card representations are not revealed until the corresponding masking means is removed, said base further including a plurality of apertures formed in said face; slide member carrying further representations of a plurality of cards thereon; and means for supporting said slide member relative to said base such that the further card representations on said slide member can be selectively moved into registration with said apertures for viewing therethrough.

17. A card game as claimed in claim 16 wherein said slide member includes at least two rows of card representations thereon.

18. A game device as claimed in claim 16 wherein said base comprises a first wall member, a surface of which constitutes said one surface, and a second, separate wall member which, with said front wall member, defines a pocket therebetween in which said slide member is received.

19. A draw poker game simulating device, said device comprising a base including representations of a plurality of cards on one face thereof and a plurality of apertures formed in said face; a slide member carrying at least two sets of card representations of five, different cards thereon corresponding to two different poker hands; and means for supporting said slide member relative to said base such that the two sets of card representations on said slide member can be selectively moved into registration with said apertures for viewing therethrough so that the different poker hands represented thereby are selectively exposed; said base member further including a removable masking means for individually masking each of the card representations so that the card representations are not revealed until the corresponding masking means is removed whereby selective removal of selected ones of the masking means reveals card representations on said face of said base member which can be combined with the poker hands exposed through said apertures to form different poker hands.

20. A game device as claimed in claim 19 wherein said base comprises a first wall member, a surface of which constitutes said one surface and a second, separate wall member which, with said front wall member, defines a pocket therebetween in which said slide member is received.

* * * * *